US005228270A

United States Patent [19]

Aarts

[11] Patent Number: 5,228,270

[45] Date of Patent: Jul. 20, 1993

[54] METHOD AND APPARATUS FOR PROCESSING A VACUUM-PACKAGE FILLED WITH GRANULAR MATERIAL

[75] Inventor: Mathias L. C. Aarts, Bilthoven, Netherlands

[73] Assignee: Sara Lee/DE N.V., Utrecht, Netherlands

[21] Appl. No.: 848,058

[22] Filed: Mar. 9, 1992

[30] Foreign Application Priority Data

Mar. 11, 1991 [NL] Netherlands ..... 9100430

[51] Int. Cl.[5] ..... B65B 1/26; B65B 31/00

[52] U.S. Cl. ..... 53/432; 53/436; 53/510; 53/526

[58] Field of Search ..... 53/432, 434, 510, 512, 53/436, 526, 527

[56] References Cited

U.S. PATENT DOCUMENTS 3,053,022 9/1962 Vogt .
3,107,793 10/1963 Frank ..... 53/526 X
3,645,198 2/1972 Field ..... 53/526 X
4,122,197 10/1978 Krugmann ..... 53/432 X
4,492,069 1/1985 Hewson ..... 53/526 X

FOREIGN PATENT DOCUMENTS 0232931 8/1987 European Pat. Off. .
1943572 3/1971 Fed. Rep. of Germany .
786368 11/1957 United Kingdom .

*Primary Examiner*—James F. Coan
*Attorney, Agent, or Firm*—Longacre & White

[57] ABSTRACT

Method and apparatus for processing a vacuum-package made from a thin-walled and flexible packaging foil, filled with a granular material, wherein the package is arranged with clearance in a holder having walls adapted for mutual relative movement, suction means create a pressure in the space around the package that is lower than the vacuum pressure in the package so that the walls of the package are straightened, the holder walls are moved towards each other by pressing means so that the straightened walls of the package are pressed against the contents of the package, the low pressure around the package is removed, the holder walls are retracted and the package is removed from the holder.

14 Claims, 2 Drawing Sheets

METHOD AND APPARATUS FOR PROCESSING A VACUUM-PACKAGE FILLED WITH GRANULAR MATERIAL

This invention relates to a method for processing a vacuum-package made from a thin-walled and flexible packaging foil, filled with a granular material, which package has been arranged in a holder for performing the processing operation. Such a method is known from U.S. Pat. No. 4,845,927, where the vacuum-package may comprise a loose granular material and the processing operation performed on the closed vacuum-package consists of folding over the top end of the package and applying an adhesive strip. A general disadvantage of vacuum-packages filled with a granular material is the fairly rough exterior of the pack. In spite of the fact that the packaging material used is a smooth packaging foil, unevennesses such as crinkles, wrinkles, creases, and the like are formed during vacuumization of the filled package. These unevennesses are undesirable from an aesthetic point of view. Printed text or pictures are distorted and errors may occur when a bar code provided on the package is being read. It is not always possible to properly stack the packages in a stable manner and this problem is aggravated if the package does not have a sufficiently exact rectangular shape, which is often the case. During transport of the packages, there is an increased risk of leakage owing to mutual chafing of the rough surfaces of the packages, taking into account that even the smallest perforations in the package cause the loss of the vacuum.

The object of the invention is to provide a method for simply and effectively processing a finished, airtightly sealed vacuum-package filled with a granular material whose packaging foil has a crinkly surface, in such a manner that it acquires a smoother surface.

To that end, the invention provides a method for processing a vacuum-package made from a thin-walled and flexible packaging foil, filled with a granular material, which package has been arranged in a holder for performing the processing operation, characterized in that the method comprises the steps of applying a subatmospheric pressure to the space formed between the package and the holder surrounding the package with some clearance, said pressure being lower than the vacuum pressure in the package so that the package expands in said space and the unevennesses in the surface of the packaging foil are straightened; subsequently moving towards each other the internally flat walls of opposite sidewalls of the holder which are adapted to be moved away from and towards each other, so that the holder presses the straightened foil against the contents of the package; removing the subatmospheric pressure externally of the package; retracting the movable sidewalls of the holder from the package and removing the package from the holder.

The invention further provides an apparatus for processing a vacuum-package made from a thin-walled and flexible packaging foil, filled with a granular material, comprising a holder for arranging therein the package to be processed, characterized in that the apparatus comprises a connection for connecting the space between the package to be arranged in the holder and the holder to surround the package with some clearance to a source of a subatmospheric pressure which is lower than the vacuum pressure in the package so as to cause the package to expand in this space and thereby to cause the unevennesses in the surface of the packaging foil to straighten, that the internally flat opposite sidewalls of the holder can be moved towards and away from each other, and that a pressing means acting on the exterior of the holder is provided for moving the movable sidewalls of the holder towards and away from each other to thereby press the straightened foil against the contents of the package.

Characteristic of the invention is, among other things, that the package is arranged in the holder with a relatively ample clearance. This means that the clearance is in any case greater than in the case where the holder supports the package on all sides. When applying a subatmospheric pressure to the space between holder and package which is lower than the vacuum pressure in the package, the packaging will expand slightly under the influence of this pressure difference, the crinkles and any other unevennesses in the packaging thereby being straightened. The magnitude of the clearance between package and holder required for the straightening operation must be determined experimentally. By way of guideline, it is considered desirable that in the situation where the pressure around the package has been lowered to the point where it is equal to the reduced pressure in the package, there still remains some clearance between the package and the holder, for instance 1 mm in height, width and depth. Thus, upon further lowering of the reduced pressure around the package, the packaging foil can expand still further until the foil comes to rest against the holder. The reduced pressure in the space between holder and package must naturally be lower than the pressure in the vacuum-package, for instance at least 10 mbar lower. In any case, the reduced pressure must be sufficiently low to overcome the resistance of the packaging foil to the smoothing action. Since the resistance of the crinkles in the package increases with time, it is desirable to subject the packages to the operation according to the invention shortly after manufacture and preferably directly after manufacture. This may moreover be desirable if, as in the case of vacuum-packaged ground coffee, the pressure in the package can increase slightly after some time as a result of gas formation within the package. Preferably, around the package such a low pressure is applied that expansion alone will cause the packaging foil to rest against the holder. After the packaging foil has been allowed to smooth under the influence of the external reduced pressure, the internally flat movable walls of the holder are pressed against the package in a mechanical, pneumatic or any other suitable manner, so that the straightened packaging foil is also pressed firmly against the contents of the package. If so desired, the holder walls are subsequently moved further towards each other, so that the contents of the package are compressed. This may be desirable in particular if the shape of the as yet unprocessed vacuum-package deviates too much from a rectangular shape. This deviation may for instance have resulted from uneven packing of the contents of the package during the filling thereof. During compression of the package, the holder can adequately give the desired rectangular shape to the package. The reduced pressure externally of the package can now be removed by bringing the space around the package into communication with the atmosphere. After the movable walls of the holder have returned to their starting position, the package can be removed from the holder.

Preferably, the holder is arranged in a thin-walled bag-shaped casing. In that case, the walls of the holder can be pressed against the package by supplying compressed air of 3–5 bar gauge pressure externally of the casing. It is efficient if the casing is designed as a double-walled bas which is arranged in a rigid chamber. By supplying compressed air between the two walls of the bag, the bag will expand, its outermost wall pushing away from the internal wall of the chamber, while the innermost wall of the bag presses the movable walls of the holder against the package. The holder can be removably arranged within the casing but may also be permanently affixed to the inside of the casing.

If so desired, during the operation according to the invention, the vacuum-package can be checked for leakage while it is still in the rigid chamber. For that purpose, the casing with holder is maintained in the condition wherein it is pressed against the package or it is pressed against the package again. The very slight residual space that remains between the casing with holder and the package is now closed off entirely. The reduced pressure in this space which is lower than that in the package can be maintained. Preferably, however, the residual space is not closed off until this space has first been brought into communication with the atmospheric outside air. For a given time, for instance 5–10 secs, the pressure in the residual space is measured as a function of time. If the package does not leak, the pressure in the space will remain substantially the same. However, if a pressure difference develops that is greater than a threshold value determined in practice beforehand, this is an indication that the package leaks. Owing to the very slight volume of the residual space relative to the space between the granules in the package, even a small perforation in the package will become manifest through a substantial pressure difference in the residual space. This option of combining the manufacture of the vacuum-package with a check for leakage in one and the same apparatus is a further important advantage of the invention.

The movable walls of the holder will generally be designed as flat plates interconnected for relative movement, for instance by spring connection members which permit the walls to move towards each other under the influence of an external force exerted on the holder and which, by virtue of their spring action, can retract the walls into a retracted position upon removal of the external force exerted on the holder. Preferably, the springs possess a certain initial resistance, so that they do not allow displacement of the holder plates until a minimum external pressure of 1 bar is exerted on the holder. Optionally, the bottom of the holder can also be movably connected to the sidewalls in a same way as the sidewalls are interconnected.

If so desired, for instance because of its better printability, a second package may be provided around the processed vacuum-package, likewise made from a thin-walled and flexible material of a different type than the first foil, for instance a paper outer packaging around an aluminum foil inner packaging. This outer packaging is not provided around the first packaging in an airtight manner. Surprisingly, it has been found that the operation on the vacuum-package according to the invention can be performed with equal results if the vacuum-package has been provided with an outer packaging prior to the operation according to the present invention. On manufacturing grounds, it is often preferred to provide the package with an outer packaging beforehand.

From the foregoing it will be clear that the invention offers a number of important advantages which are summarized in the following:

- improved appearance of the package
- improved legibility of the printed text on the packaging
- fewer errors in reading a bar code
- reduced risk of leakage during further handling and transport
- increased stacking density
- improved stacking stability
- increased accuracy of shape of the packages
- option of a simultaneous check for leakage in the processed packages
- option of subjecting the vacuum-package to the operation even when a second packaging has been provided around the vacuum-package.

The invention will be further explained and illustrated, by way of example, with reference to the accompanying drawings, in which.

Figure 1:
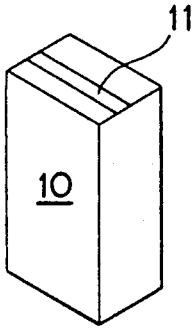
FIG. 1 shows a package filled with a granular material, before a vacuum has been applied to the interior thereof.
Figure 2:
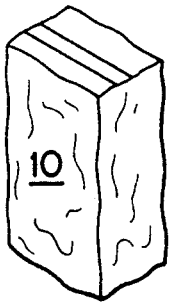
FIG. 2 shows the package shown in FIG. 1 after a vacuum has been applied to the contents of the package and the package has been airtightly sealed.
Figure 3:
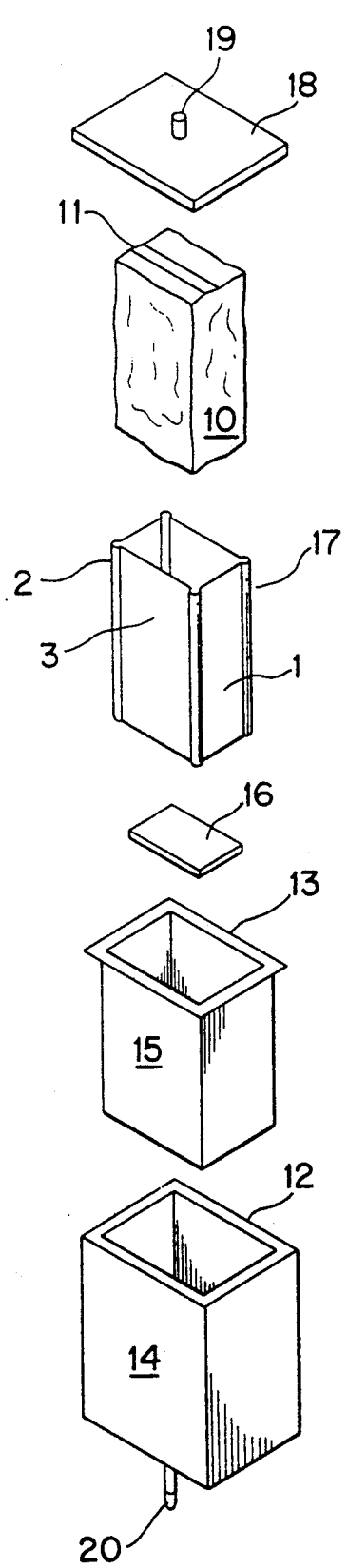
FIG. 3 shows different parts of an apparatus for performing the method according to the invention.
Figure 4:
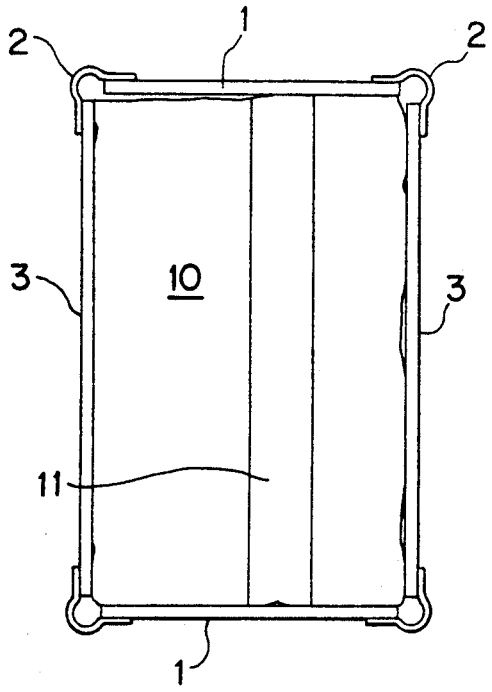
FIG. 4 is a top plan view of a holder for use in an apparatus according to the invention.

FIG. 1 shows a rectangular, still unvacuumized, package 10 filled for instance with 250 g of ground coffee. The package comprises a folded closing tab 11, but has not been hermetically sealed yet. The pressure in the package is equal to the atmospheric ambient air pressure. The package is made of a thin flexible packaging foil, for instance paper or aluminum foil, and its walls are smooth. While vacuum is applied to the interior of the filled package, the package is sealed hermetically. Under the influence of the external atmospheric pressure, the packaging foil is pressed firmly against the granular contents of the package, so that the package acquires a crinkled appearance (FIG. 2) and often no longer has sufficiently precise rectangularity. In accordance with the improvement of the present invention, the package is now subjected to an operation in an apparatus shown in the exploded view of FIG. 3. Starting at the bottom, FIG. 3 shows a box-shaped chamber 14 comprising a rigid bottom and rigid walls. Mounted on the bottom is a connection stub 20 which communicates via an aperture in the bottom with the interior of the chamber. The stub 20 can be connected either to a source of compressed air or a source of vacuum. Shown above the chamber 14 is a bag-shaped body 15. The bag 15 comprises a bottom and sidewalls of thin-walled flexible material, for instance rubber foil, having a rigid flanged projecting edge 13 extending along the top edge 12. The shape and dimensions of the rubber bag 15 are such that the bag fits into the chamber 14 with slight clearance, the edge 13 coming to rest on the top edge 12 of the chamber. Shown above the bag 15 is a holder 17 with associated loose bottom plate 16. The holder comprises narrow plate-shaped flat sidewalls 1 and wide plate-shaped flat sidewalls 3 which are interconnected via spring connection members 2 for relative movement (see also FIGS. 4–6). Optionally, the loose bottom 16 can be connected to the sidewalls of the holder in a similar manner by means of spring members. In the inoperative position of the holder, the inner shape thereof largely corresponds to the outside dimensions of the vacuum-package 10 to be processed. The inside dimensions of the holder, however, are greater than the corresponding outside dimensions of the package, so that the package can be arranged in the holder with a slight roundabout clearance between the sidewalls of the holder and the package. The holder 17 with bottom 16 fits into the bag 15. After the package 10, the holder 17 with bottom 16, and the bag 15 have been arranged in the chamber, the chamber can be closed hermetically with a closing plate or cover 18 fitted with a connection stub 19 which can be connected to a source of vacuum.

Figure 5A:
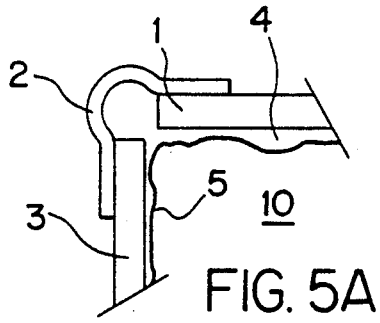
FIGS. 5A–5D are top plan views of a corner portion of the holder shown in FIG. 4 having disposed therein a vacuum-package (shown in section) in each of four successive steps of the method according to the invention.
Figure 5B:
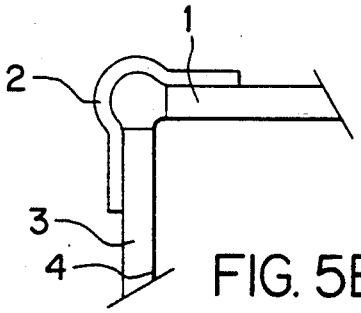

The operation of the apparatus will now be explained with reference to FIGS. 3 and 5. First, the apparatus is made ready for operation by arranging the bag 15 with holder 17 and bottom 16 in the chamber 14. The package to be processed is arranged in the holder and the chamber is closed by means of the cover 18, with the top edge 13 of the bag 15 being hermetically clamped between the top edge 12 of the chamber and the underside of the cover 18. When the cover has been arranged on the chamber, some clearance remains present between the top of the package and the flat underside of the cover. Then the connection stub 20 is connected to a vacuum pump, so that vacuum is applied to the closed space between the inner wall of the chamber and the exterior of the bag. As a result, the bag will come to rest against the inner walls of the chamber. In this condition, the bag will be unable to exert any pressure on the holder arranged therein, so that the holder assumes the inoperative position. This is the situation as shown in FIG. 5A. The connection stub 19 on the cover is now connected to a vacuum pump, so that the space within the bag, including the slit-shaped space 4 between the holder and the package, is vacuumized, i.e., down to a pressure lower than the pressure in the vacuum-package. The package will thereby swell and the pressure within the package will decrease as a result of the increase of volume thereof. When the pressure in the space 4 between package and holder has been lowered sufficiently, the package will expand to such an extent that the packaging foil comes to rest against the sidewalls and the bottom of the holder and the underside of the cover. When the package swells, the packaging foil is straightened, so that the unevennesses thereof will disappear for the greater part or completely. This situation is shown in FIG. 5B.

Then, via connection 20, compressed air of for instance 5 bar gauge pressure is supplied to the space between the bag and the chamber. As a result, the bag is pressed firmly against the holder, so that the mutually movable walls of the holder move towards each other and are pressed against the package. At the same time, the bottom of the holder is pushed up by the bag, so that the package is pressed against the underside of the cover. During this movement of the holder, an excess pressure relative to the external pressure continues to prevail in the package, so that the foil remains pressed tightly against the holder. While the package is being subjected to pressure exerted by the holder and is optionally compressed, it acquires the desired rectangular shape which is determined by the walls of the holder including the bottom thereof and the cover 18. The parts of the packaging foil that have become "redundant" as a result of the straightening of the foil collect in the corners of the package in the form of projecting fins 6 (FIG. 5C, where the fins are shown on a larger scale for clarity).

Figure 5C:
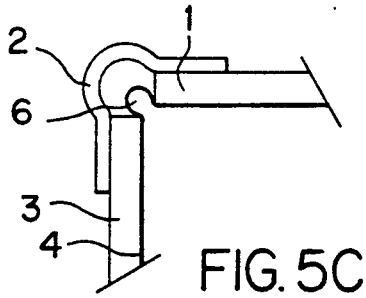
Figure 5D:
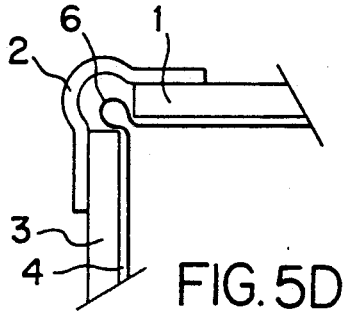

While the holder is still exerting pressure on the package, the connection 19 on the cover is made to communicate with the outside air. The foil remains pressed tight and unwrinkled against the contents of the package. Then the connection 20 is also brought into communication with the atmosphere, so that the holder can spring back into its inoperative position (FIG. 5D). Although the package now sits free within the holder, the package remains smooth on account of the atmospheric pressure. The chamber can now be opened by removing the cover and the processed package can be taken from the holder.

Optionally, during the operation, the package can at the same time be checked for leakage. Two methods are available for this purpose. According to the first method, the space 4 is closed off while it is still under vacuum and the holder still retains the package in pressed condition (FIG. 5C). Connection 19 is then connected to a pressure gauge which measures the course of the pressure as a function of time for a predetermined time. Since the pressure in space 4 is lower than that in the package, the pressure in space 4 will rise if the package leaks, while such a pressure increase will not occur in a package that does not leak. According to the second method, the space 4 between package and holder, with the holder being maintained in its pressing condition, is not closed off until after the space 4 has been brought into communication with the atmosphere. As in the first method, the course of the pressure in space 4 is then measured for a given time. Since the pressure externally of the package is now higher than that within the package, a leak in the package will now manifest itself through a pressure drop in the space 4.

Figure 6:
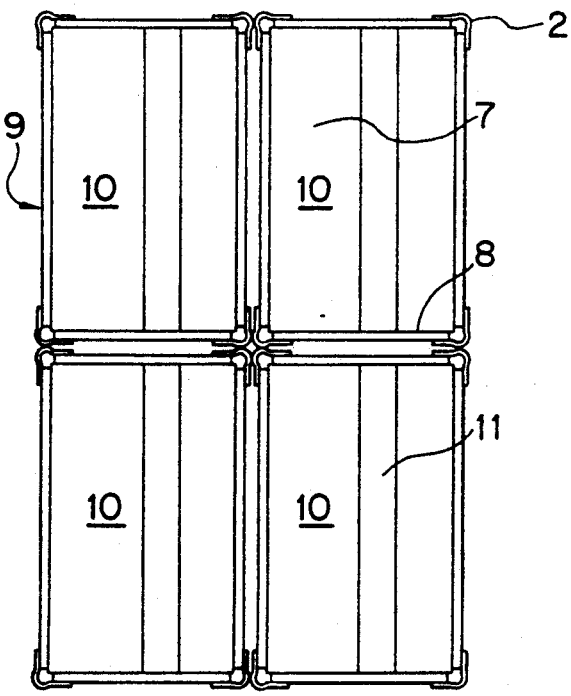
FIG. 6 is a top plan view of an extended holder for simultaneously processing four vacuum-packages.

The operation according to the invention can also be performed simultaneously on more than one package. Thus, FIG. 6 shows a combination 9 of four holders which are coupled to each other by means of non-compressible intermediate pieces 7, 8. This combination is arranged in a common bag basically corresponding to bag 15 and in a common chamber with cover, basically corresponding to the chamber 14 and cover 18. In this case, the four packages in the combination are processed simultaneously.

What I claim is:

1. A method for processing a vacuum-package made from a thin-walled and flexible packaging foil, filled with a granular material, which package has been arranged in a holder for performing the processing operation, characterized in that the method comprises the steps of applying a subatmospheric pressure to the space formed between the package and the holder surrounding the package with some clearance, said pressure being lower than the vacuum pressure in the package so that the package expands in said space and the unevennesses in the surface of the packaging foil are straightened, subsequently moving towards each other the internally flat walls of opposite sidewalls of the holder which are adapted to be moved away from and towards each other, so that the holder presses the straightened foil against the contents of the package, removing the subatmospheric pressure externally of the package, retracting the movable sidewalls of the holder from the package, and removing the package from the holder.

2. A method according to claim 1, characterized in that the contents of the package are compressed by the moving sidewalls of the holder.

3. A method according to claim 1, characterized in that the pressure in the space between the package and the holder is lowered at least to such an extent that thereby the packaging foil comes to rest against the walls of the holder.

4. A method according to claim 1, characterized in that the holder is arranged in a thin-walled bag-shaped casing and the walls of the holder are pressed against the package by supplying compressed air externally of the casing.

5. A method according to claim 4, characterized in that said casing is designed as a double-walled bag arranged in a rigid chamber and the compressed air is supplied between the two walls of the bag, while the innermost wall of the bag is pressed against the holder and the outermost wall of the bag is pressed against the rigid walls of the chamber.

6. A method according to claim 4, characterized in that while the movable walls of the holder are pressed against the package, the residual space between the package and the holder with the casing fitting closely around it is closed off and the course of the pressure in this space is measured as a function of time for a given time for determining the possible presence of a leakage in the package.

7. A method according to claim 6, characterized in that the residual space is brought into communication with the atmosphere before being closed off.

8. A method according to claim 1, characterized in that the operation is performed after a second thin-walled and flexible foil has been provided around the vacuum-package.

9. A method according to claim 1, characterized in that the processing operation is performed directly upon production of the vacuum-package.

10. An apparatus for processing a vacuum-package made from a thin-walled and flexible packaging foil filled with a granular material, comprising a holder for arranging therein the package to be processed, characterized in that the apparatus comprises a connection for connecting the space between the package to be arranged in the holder and the holder to surround the package with some clearance to a source of a subatmospheric pressure which is lower than the vacuum pressure in the package so as to cause the packaging to expand in this space and thereby to cause the unevennesses in the surface of the packaging foil to straighten, that the internally flat opposite sidewalls of the holder can be moved towards and away from each other, and that a pressing means acting on the exterior of the holder is provided for moving the movable sidewalls of the holder towards and away from each other to thereby press the straightened foil against the contents of the package.

11. An apparatus according to claim 10, characterized in that the movable walls of the holder are interconnected for movement relative to each other.

12. An apparatus according to claim 10, characterized in that the holder has been arranged in a thin-walled bag-shaped casing and the apparatus further comprises a connection for supplying compressed air externally of the casing for moving the walls of the holder towards each other.

13. An apparatus according to claim 12, characterized in that the holder is mounted on the inside of the casing.

14. An apparatus according to claim 12, characterized in that the bag-shaped casing has been arranged in a rigid chamber accessible at one end thereof, at which end the chamber comprises a removable closing plate for airtight sealing of the chamber while the holder with package is arranged in the casing, with the connection for applying a subatmospheric pressure to the space between package and holder being mounted on the closing plate of the chamber.

* * * * *